United States Patent [19]

Soeters, Jr.

[11] 4,203,397

[45] May 20, 1980

[54] ENGINE VALVE CONTROL MECHANISM

[75] Inventor: Raymond A. Soeters, Jr., West Bloomfield Township, Oakland County, Mich.

[73] Assignee: Eaton Corporation, Cleveland, Ohio

[21] Appl. No.: 915,476

[22] Filed: Jun. 14, 1978

[51] Int. Cl.[2] ..... F01L 1/34; F02D 13/06

[52] U.S. Cl. ..... 123/90.16; 123/90.17; 123/90.27; 123/198 F

[58] Field of Search ..... 123/90.15, 90.16, 90.17, 123/90.18, 90.22, 90.27, 198 F

[56] References Cited

U.S. PATENT DOCUMENTS

| | | | |
|---|---|---|---|
| 2,266,077 | 12/1941 | Roan | 123/90.16 |
| 2,443,999 | 6/1948 | Wright | 123/198 F |
| 2,934,052 | 4/1966 | Longenecker | 123/90.16 |
| 3,277,874 | 10/1966 | Wagner | 123/90.16 |
| 3,422,803 | 1/1969 | Stivender | 123/90.16 |
| 3,641,988 | 2/1972 | Torazza et al. | 123/90.16 |
| 3,964,455 | 6/1976 | Brown | 123/90.16 |
| 4,151,817 | 5/1979 | Muellen | 123/90.16 |

*Primary Examiner*—Ira S. Lazarus

*Attorney, Agent, or Firm*—R. J. McCloskey; D. Wood; P. Rulon

[57] ABSTRACT

An engine valve control mechanism for varying the amount of opening and/or timing of a cylinder valve in a valve gear train of a multi-cylinder, internal combustion engine having an overhead camshaft which actuates the valve via a rocker arm pivotally bridged between the valve stem and a hydraulic lash adjuster. In one engine embodiment of the invention, the valve gear train portion for each intake valve is provided with a valve control mechanism of the invention by providing a camshaft having a high lift lobe and two low lift lobes for actuating the valve and by providing a valve rocker arm including a rigid link defining a first cam follower for following the low lift lobes and a second cam follower pivotally connected to the rigid link for following the high lift lobe. A latch, carried by the rigid link, is operative in a first position to prevent pivotal movement of the second follower relative to the rigid link, whereby the valve is actuated by the high lift lobe, and operative in a second position to allow such pivotal movement, whereby the valve is actuated by the low lift lobes. The latch is operated by a solenoid supported by the lash adjuster. In a second embodiment of the invention, the low lift lobes are removed, whereby the valves are disabled when the latch is in the second position.

20 Claims, 5 Drawing Figures

ENGINE VALVE CONTROL MECHANISM

CROSS-REFERENCE TO RELATED APPLICATION

This application is related to U.S. patent application 750,924 filed Dec. 15, 1976 and now U.S. Pat. No. 4,151,817. Patent 4,151,817 is assigned to the assignee of this application and is incorporated herein by reference.

BACKGROUND OF THE INVENTION

1. Field of the Invention

The invention relates to an improved mechanism for controlling a valve actuated by a camshaft and more specifically to a mechanism to vary the amount of opening and/or timing of cam actuated valves.

2. Description of the Prior Art

It is well known in the internal combustion engine art that a more flexible control of the engine valves will provide improved power and economy at virtually all engine speeds and loads. One method of providing more flexible valve control is taught in U.S. Pat. Nos. 2,934,052 and 3,277,874. Therein the camshafts are provided with high and low lift lobes for actuating each of the engine valves and means selectively operative to shift from valve actuation by one of the lobes to valve actuation by other of the lobes for varying the amount of valve opening and/or valve timing in accordance with engine operating conditions. It is also well known in the internal combustion engine art that improved operating economy may be obtained by disabling the valves of selected cylinders during certain engine operating conditions, for example, when the engine is lightly loaded. Prior U.S. Patent art is replete with patents teaching valve disablement.

The above mentioned patent application, like this application, discloses a valve control mechanism including a camshaft having a high lift lobe and two low lift lobes, a rigid link defining a rocker arm with two first cam followers which cooperate with the low lift lobe, a second cam follower pivotally connected to the link, a latch carried by the link, and a solenoid for controlling the latch. In the valve control mechanism of the mentioned patent application, the second cam follower is pivotally supported by the rocker arm adjacent to the lash adjuster end of the rocker arm, the latch is positioned about mid-way between the two ends of the rocker arm, and the solenoid is supported by the valve head structure. In the improved valve control mechanism of this application, the latch is positioned adjacent to the lash adjuster end of the rocker arm by pivotally supporting the second cam follower at the other end of the link or rocker arm and the solenoid is supported on the lash adjuster piston, which piston moves vertically up and down to control lash in the valve gear train. This arrangement of the latch and solenoid reduces inertia of the rocker arm, reduces the distance between the latch linkage and solenoid armature, and minimizes relative movement between the solenoid armature and the latch linkage.

SUMMARY OF THE INVENTION

According to a feature of the invention, a valve control rocker arm is provided which includes a rigid link bridged between a valve stem and a lash adjuster and pivoted about the lash adjuster by a lobe of a camshaft, a cam follower moveably mounted on the link and adapted to follow the cam lobe, a latch carried by the link at a position disposed adjacent the lash adjuster and operative in first and second positions, respectively, to prevent and allow movement of the cam follower relative to the link, and an actuator supported by the lash adjuster and operative to move the latch between the first and second position.

BRIEF DESCRIPTION OF THE DRAWINGS

The preferred embodiment of the invention is shown in the accompanying drawings in which.

Certain terminology referring to direction and motion will be used in the following description. The terminology is for convenience in describing the disclosed embodiment and should not be considered limiting unless explicitly used in the claims.

Figure 4:
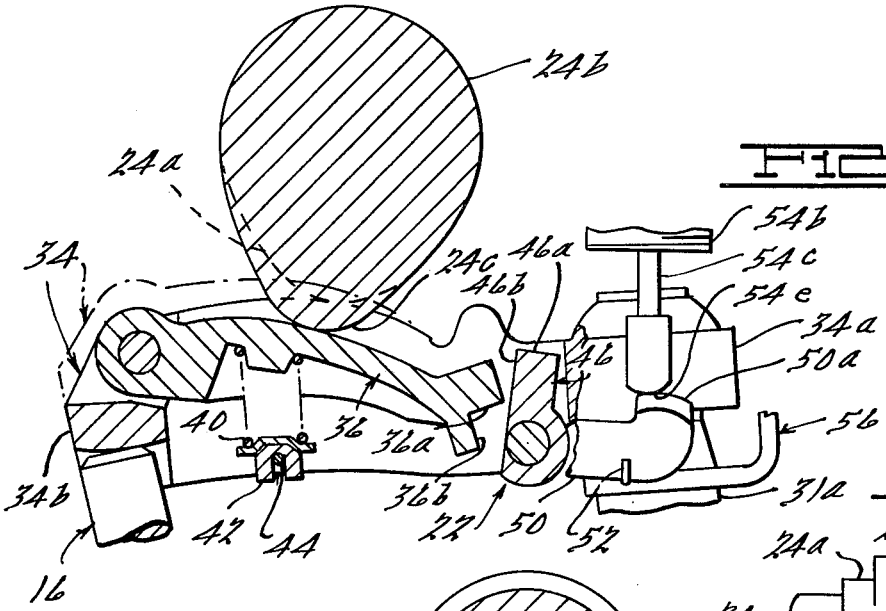
FIG. 4 depicts an operational mode of the rocker arm of FIG. 1.
Figure 5:
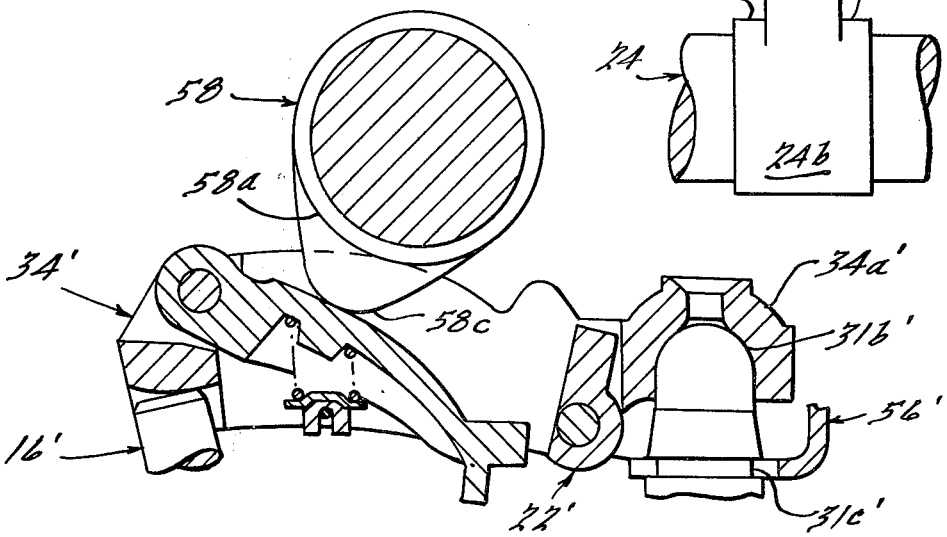
FIG. 5 depicts an alternative to the cam lobe arrangement of FIG. 1.

In the alternative embodiment of FIG. 5, primed numbers designate elements unchanged from FIGS. 1–4.

DETAILED DESCRIPTION OF THE INVENTION

Figure 1:
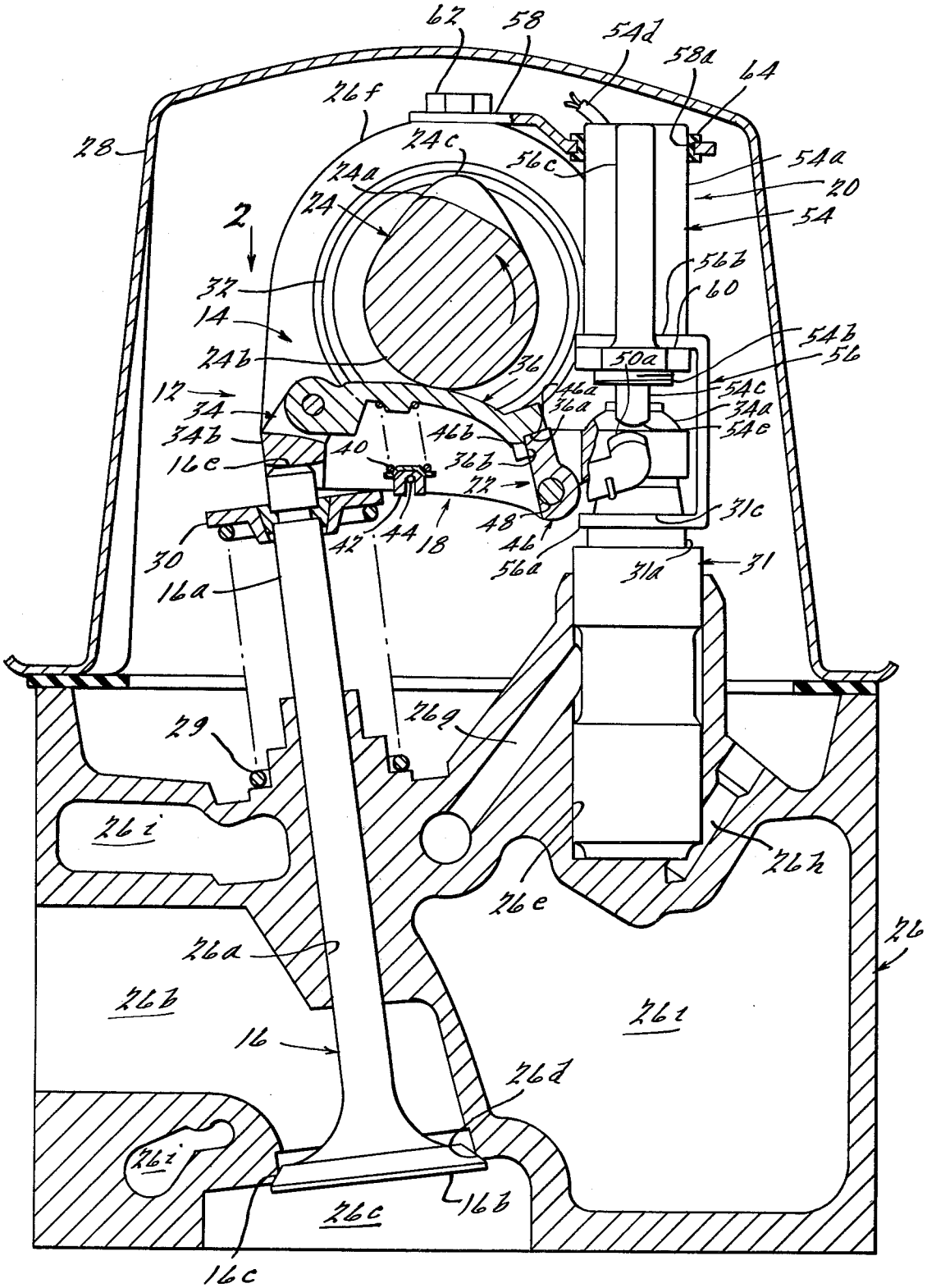
FIG. 1 is a partially sectioned view of an internal combustion engine cylinder head embodying a valve control rocker arm and camshaft of the invention valve control mechanism.

Referring now to FIG. 1, therein is shown in cross-section an internal combustion engine cylinder head assembly of the overhead camshaft type and the inventive valve control mechanism 12 adapted to readily fit into a valve gear train portion 14 for actuating an engine cylinder valve 16. The valve control mechanism includes a rocker arm mechanism 18 which replaces a conventional rocker arm, a solenoid mechanism 20 for positioning a latch mechanism 22 carried by rocker arm mechanism 18, and a camshaft 24 which replaces a conventional camshaft.

The head assembly forms no part of the invention and is shown to merely provide one example of the type of environment in which valve control mechanism 12 may be embodied. The head assembly includes valve gear train 14, a cast head structure 26, and a sheet metal valve cover 28.

Valve 16 is of the poppet type having a stem portion **16*a* slideably disposed in a guide 26*a* defined by head structure 26 and a valve head portion 16*b*. Valve head portion 16*b* blocks the flow of gases between a passage 26*b* and a recess 26*c* when a conical face 16*c* on the valve head rests on a mating valve seat 26*d* defined or supported by the head structure. Recess 26*c* opens into an unshown combustion chamber which may be cylindrically shaped and have therein a reciprocating piston. Valve 16 is biased on the closed position by a spring 29 which reacts between the head structure and a conventional valve spring retainer 30**.

The valve gear train portion 14 is substantially conventional with the exception of the valve control mechanism. Valve gear train portion 14 includes valve 16, rocker arm mechanism 18 pivotally supported at one end by a hydraulic lash adjuster 31 contained in a bore 26e defined by the head structure, and camshaft 24 journaled in a bearing 32 supported by an arched portion 26f defined by the head structure. Lash adjuster 31 includes a piston 31a having a hemisperical end 31b (see FIG. 5) for pivotally supporting one end of the rocker arm.

The head structure 26 includes, in addition to the above, a passage 26g for supplying pressurized oil to the lash adjuster, a passage 26h for draining bore 26e and assisting in the installation of the adjuster, and three irregularly shaped coolant passages 26i.

Figure 2:
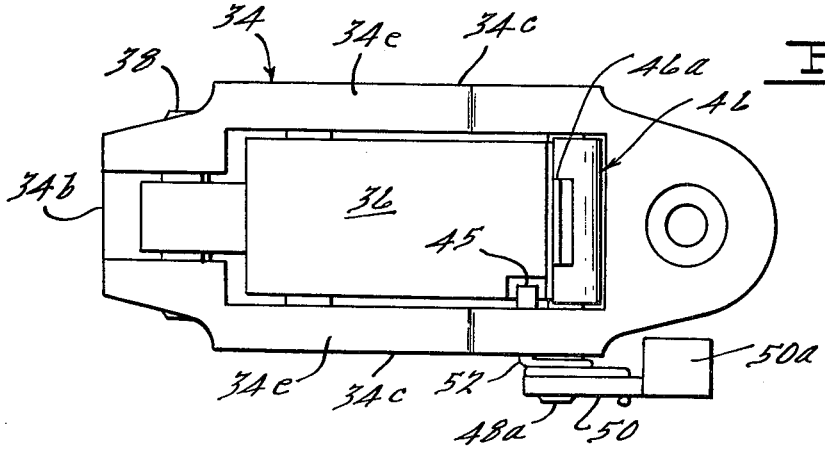
FIG. 2 is a view of the rocker arm looking in the direction of arrow 2 of FIG. 1.
Figure 3:
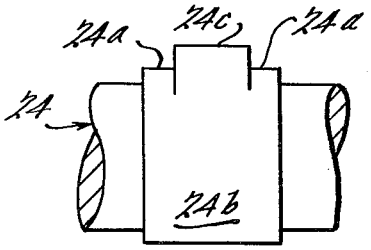
FIG. 3 is a partial view of the camshaft of FIGS. 1 and 4 in reduced size.

Referring now to FIGS. 1, 2, and 3, camshaft 24 includes a smooth circumferential surface which may be machined or finished by well known methods to define a first surface portion which includes a first pair of low lift cam lobes 24a projecting radially outward from a cylindrical surface or dwell portion 24b and a second high lift cam lobe 24c of substantially conventional height and profile and interposed between lobes 24a. Cylindrical surface 24b is common to lobes 24a and lobe 24c, concentric to the axis of the camshaft, and defines what is commonly referred to as the base circle of the cam lobes.

High lift cam lobe 24c is for effecting a full opening of valve 16 during relatively high engine loading. Low lift cam lobes 24a are for effecting a partial opening of valve 16 during relatively low engine loading. Cam lobes 24a have identical height and circumferential positions with respect to each other and are completely confined within the circumferential and radial extent of the profile of cam lobe 24c.

Rocker arm mechanism 18 includes an elongated rigid one piece link 34, a cam follower 36 pivotally hinged to the link at a position adjacent to valve 16 by a pin 38, the latch mechanism 22 carried by the link adjacent to the lash adjuster and selectively operative to prevent movement of the follower 36 relative to the link, and a helical spring 40 for biasing cam follower 36 toward engagement with the high lift cam lobe 24c.

Rigid link 34 is pivotally bridged or supported at its ends by the lash adjuster piston 31a and the valve 16 in a conventional manner. Rigid link 34 includes an end portion 34a adapted to pivotally receive the hemisperical end 31b of the lash adjuster piston, an end portion 34b adapted to drivingly engage an end portion 16e of the valve stem, and two rail portions 34c. Rail portions 34c rigidly interconnect the end portions, define surface portions or first cam follower surfaces 34e which drivingly engage the low lift cam lobes on the first surface portions of the camshaft. A spring support bridge 42 is fixed between rail portions 34c by a pin 44 pressed in holes in the rails. Spring 40 reacts between bridge 42 and the lower surface of pivotal cam follower 36. A pin 45, pressed through an unshown hole in one of the rails 34c, defines a stop for fixing the upward pivotal position of follower 36.

Cam follower 36, which is pivotally hinged to the link by pin 38 in trap door fashion, functions as a second cam follower which cooperates with the high lift cam lobe 24c. The right end of follower 36 includes a notched portion having a downwardly facing surface 36a and a rightwardly facing surface 36b.

Latch assembly 22 includes a rotatable latch member 46 non-rotatably fixed to a pin 48 which is rotatably journaled in axially aligned and unshown holes in rails 34c, a lever 50 non-rotatably fixed to an extended end portion 48a of the pin, and a torsion spring 52 for biasing the lever and latch member counterclockwise as viewed in the drawings. Lever 50 is partially shown in FIGS. 1 and 4. Latch member 46 includes a radially extending portion having upwardly and leftwardly facing surfaces 46a and 46b, respectively, engaging surfaces 36a and 36b. When latch member 46 is in the latched or first position, as shown in FIG. 1, surfaces 36a and 46a engage to prevent movement of the second cam follower 36 relative to the link. Surfaces 36b and 46b engage to limit counterclockwise rotation of the latch member due to the biasing force of spring 52 and the over center position of surface 46a with respect to a vertical plane extending through the axis of pin 48. One end of spring 52 is retained in an unshown hole in rail 34c and the other end is looped around lever 50. Lever 50 includes a pad 50a having a curved upper surface whose highest vertical extent is above the center of the hemispherical end 31b of piston 31a when the latch is in the first position, as shown in FIG. 1, and is horizontally aligned with the center when the latch is in a second or unlatched position as shown in FIG. 4. With the latch in the first position of FIG. 1, the curvature of surface 50a is made to define a portion of a cylinder having an axis extending through the center of the hemisphere 31b and normal to the longitudinal axis of the piston 31a.

Solenoid assembly 20 includes a solenoid 54, a C-shaped bracket 56, and a retaining plate 58. Bracket 56 and plate 58 are shown in partial section. Solenoid 54 includes cylindrical jacket 54a, a threaded end 54b, a push armature 54c, and a pair of conductors 54d. Bracket 56 includes a bifurcated end 56a which snaps over a groove 31c in piston 31a, an aperatured end 56b which receives threaded end 54b, and a vertically extending tang 56c spaced from the cylindrical wall of jacket 54a. A nut 60 firmly fixes the solenoid against movement relative to bracket 56. Retaining plate 58 extends along the length of the head and is fixed to each arched portion 26f by bolts 62. Herein only one arch and bolt is shown. Plate 58 includes aperatures 58a which are each lined with a nylon grommet 64 for slideably receiving the upper portion of cylindrical jacket 54a and an unshown slot or notched portion which slideably receives tang 56c for preventing rotation of solenoid 54 and bracket 56. Armature 54c includes a partially spherical end 54e which is slightly spaced from surface 50a when the solenoid is in the deenergized position of FIG. 1.

From the foregoing, it should be apparent that a part of the camshaft is always in unyielding contact with the rigid link of the rocker arm regardless of the position of latch mechanism 22. For example, when the valve is inactive or closed, the cylindrical surface or dwell portion 24b of the base circle, as shown in FIG. 1, is in direct contact with the first cam followers defined by the rigid link. When latch mechanism 22 is in the first position, preventing movement of the second cam follower relative to the rigid link, cam lobe 24c is unyieldably connected to the rigid link via the latch mechanism. And when latch mechanism 22 is in the second position, allowing movement of the second cam follower relative to the rigid link, cam lobes 24a are unyieldably connected to the rigid link. This unyielding contact between the camshaft and the rigid link of the rocker arm prevents ballooning or over extension of hydraulic lash adjuster 31 or any analogous device for automatically removing lash from the valve gear train and allows the use of a relatively low force spring 40 for biasing the second cam follower. However, the force of spring 40 could be increased to prevent ballooning of the lash adjuster.

OPERATION

When the solenoid is deenergized and latch member 46 is in the latched or first position, as shown in FIG. 1, pivotal movement of the second cam follower 36 relative to rigid link 34 is prevented, whereby high lift cam lobe 24c actuates valve 16 by moving the second cam follower and the rigid link in unison in response to rotation of the camshaft. During this phase of valve operation, end 54e of the solenoid armature remains spaced from the curved upper surface of the pad 50a since the surface rotates about its axis which extends through the center of the hemispherical end of the lash adjuster piston.

When the solenoid is energized, armature 54c applies a predetermined force to pad 50a for effecting clockwise rotation of the lever and latch member 46 to the unlatched or second position. This force effects rotation only when the camshaft is in dwell with respect to the rocker arm. When the camshaft is not in dwell (i.e., the valve is open), the frictional force between surfaces 36a and 46a prevent the clockwise rotation until the camshaft is in dwell (i.e., the valve is closed). To prevent sliding movement of armature end 54e on the upper surface of pad 50a, the stroke of the armature is set to move the surface down until it lies along the cylinder axis extending through the center of the hemispherical end of the lash adjuster piston.

In FIG. 5, a camshaft 58 is provided with one high lift cam lobe 58c corresponding substantially with high lift cam lobe 24c of camshaft 24 and two cylindrical surfaces 58a concentric to the rotational axis of the camshaft and separated by cam lobe 58c, whereby the valve 16' is completely disabled when latch mechanism 22' allows movement of second cam follower 36' relative to rigid link 34'.

A preferred embodiment of the invention has been disclosed for illustrative purposes. Many variations and modifications of the preferred embodiment are believed to be within the spirit of the invention. The following claims are intended to cover the inventive portions of the preferred embodiment and variations and modifications believed to be within the spirit of the invention.

What is claimed is:

1. In an internal combustion engine including at least one cylinder valve; a lash adjuster having a moveable portion for controlling valve train lash in the engine; a camshaft mounted for rotation in the engine and including a circumferential surface defining a first surface portion and a cam lobe projecting radially outward from the circumferential surface and axially adjacent to the first surface portion; a rigid link means supported on its end by the valve and lash adjuster and defining on a surface thereof a first follower means in direct contact with the first surface portion of the camshaft; a second follower means disposed adjacent the first follower means, moveable relative to the rigid link means, and in direct contact with the cam lobe; and latch means selectively moveable to a first position preventing movement of said second follower means relative to the link and a second position allowing such relative movement; wherein the improvement comprises:

actuation means mounted on the moveable portion of the lash adjuster and selectively operative to move said latch means between said first and second positions.

2. The engine of claim 1 wherein said latch means is supported on said movable portion of said lash adjuster for pivotal movement about a pivotal axis defined by said moveable portion, said latch means supported by said link means for pivotal movement between said first and second positions, and wherein said improvement further includes:

a lever fixed at one end for pivotal movement with said latch means and having a surface at the other end movable by said actuation means, said lever operative to pivot said latch means from said first position to said second position in response to said surface being moved from a position radially spaced from said pivotal axis to a position wherein said pivotal axis lies substantially on said surface.

3. The improvement of claim 2 wherein said surface is a curved surface.

4. The improvement of claim 2 wherein said surface is a curved surface substantially concentrical to said pivotal axis when said latch means is in said first position.

5. The improvement of claim 2, 3 or 4 further including:

a spring for biasing said surface to said radially disposed position.

6. The engine of claims 1, 2, 3, or 4, wherein said movable portion is a piston of a hydraulic lash adjuster, said piston moves along an axis substantially normal to said pivotal axis, and wherein said actuation means further includes:

a solenoid having housing portion;

a bracket mounting said solenoid on said piston; and a retaining plate secured to a nonmovable portion of said engine and slideably receiving said solenoid housing portion.

7. The improvement of claim 6, wherein said actuation means further includes:

means for preventing rotational movement of said solenoid housing portion and said bracket relative to said substantially normal and to said pivotal axis of said piston.

8. The engine of claim 1, wherein said cam lobe is a high lift cam lobe; wherein said first surface portion of said camshaft further defines a low lift cam lobe projecting radially outward from said surface, said low lift cam lobe confined within the circumferential and radial extent of said high lift cam lobe and in direct contact with said first follower means; and wherein said improvement further includes:

means pivotally mounting said second follower on said link means at a position adjacent the valve end of said link; and means supporting said latch means on said link means at a position adjacent the lash adjuster end of said link means.

9. The engine of claim 1, wherein said cam lobe is a high lift cam lobe; wherein said first surface portion of said camshaft further defines a pair of low lift cam lobes projecting radially outward from said surface on either side of said high lift lobe, said low lift cam lobes confined within the circumferential and radial extent of said high lift lobe; wherein said first follower means includes a pair of followers disposed on either side of said second follower means and each in contact with a respective one of said low lift cam lobes; and wherein said improvement further includes:

means pivotally mounting said second follower means on said link means at a position adjacent the valve end of said link means; and means supporting said latch means on said link means at a position adjacent the lash adjuster end of said link means.

10. In a valve control means adapted for incorporation into an internal combustion engine valve gear train including a cylinder valve, a lash adjust, and a camshaft having a cam lobe; said control means including a rigid link adapted to be supported at one end by the valve and supported at the other end by a movable portion of the lash adjuster for pivotal movement about a pivotal axis defined by the movable portion, a cam follower pivotally hinged to said link and adapted to contact said cam lobe in response to rotation of the camshaft, and latch means supported by said link and moveable between first and second positions respectively operative to prevent and allow pivotal movement of said cam follower relative to said link; the improvement comprising:

a lever connected at one end to said latch means and having a surface at the other end adapted to be contacted by an actuator for movement from a position radially spaced from said pivotal axis to a position wherein said pivotal axis lies substantially on said surface, said lever operative to position said latch means in said first position when said surface is radially spaced from said pivotal axis and operative to position said latch means in said second position when said pivotal axis lies substantially on said surface.

11. The improvement of claim 10, wherein said surface is a curved surface.

12. The improvement of claim 10, wherein said surface is a curved surface substantially concentric to said pivotal axis when said latch means is in said first position.

13. The improvement of claims 10, 11, or 12 further including:

a spring for biasing said surface to said radially disposed position.

14. The improvement of claims 10, 11, or 12, further includes:

actuation means adapted to be mounted on the moveable portion of the lash adjuster and having a plunger operative in response to actuation of said solenoid to contact said surface and effect said movement of said surface.

15. The control means of claim 14, wherein said actuation means further includes:

a solenoid having a housing;

a bracket adapted to mount said solenoid housing on said moveable portion; and a retaining plate adapted to be secured to a nonmoveable portion of the engine and slideably receiving said solenoid housing.

16. The improvement of claim 10, wherein said actuation means further includes:

means for preventing rotational movement of said solenoid housing portion and said bracket relative to movable portion.

17. The valve control means of claim 10, wherein said rigid link defines a second cam follower rigid with said link and adapted to contact a second cam lobe disposed adjacent the first mentioned cam lobe and wherein said improvement further includes:

means pivotally mounting said second follower on said link means at a position adjacent the valve end of said link;

means supporting said latch on said link at a position adjacent the lash adjuster end of said link.

18. The valve control means of claim 16, wherein said rigid link defines a pair of cam followers rigid with said link and adapted to contact a pair of cam lobes disposed adjacent the first mentioned cam lobe and wherein said improvement further includes:

means pivotally mounting said second follower on said link means at a position adjacent the valve end of said link; and means supporting said latch on said link at a position adjacent the lash adjuster end of said link.

19. A valve control means adapted for incorporation into an internal combustion engine valve gear train including a cylinder valve, a lash adjuster having a movable portion for controlling valve train lash, a camshaft having a cam lobe, said valve control means comprising:

a rigid link adapted to be supported at one end by the valve and pivotally supported at the other end by the movable portion of the lash adjuster;

a cam follower pivotally hinged to said link at a position adjacent said one end and adapted to contact said cam lobe in response to rotation of the camshaft;

latch means supported by said link at a position adjacent said other end, said latch means operative in a first position to prevent pivotal movement of said cam follower relative to said link for effecting actuation of said valve by said cam lobe, and said latch means operative in a second position to allow pivotal movement of said follower relative to said link to render said cam lobe at least partially ineffective for actuating said valve; and actuation means mounted on the moveable portion of the lash adjuster and selectively operative to move said latch means between said first and second positions.

20. A valve control means adapted for incorporation into an internal combustion engine valve gear train including a cylinder valve, a lash adjuster having a movable portion for controlling valve train lash, a camshaft having a cam lobe, said valve control means comprising:

a rigid link adapted to be supported at one end by the valve and supported at the other end by the movable portion of the lash adjuster for pivotal movement about a pivotal axis defined by the moveable portion;

a cam follower pivotally hinged to said link at a position adjacent said one end and adapted to contact the cam lobe in response to rotation of the camshaft;

latch means supported by said link at a position adjacent said other end, said latch means operative in a first position to prevent pivotal movement of said cam follower relative to said link for effecting actuation of said valve by said cam lobe, and said latch means operative in a second position to allow pivotal movement of said follower relative to said link to render the cam lobe at least partially ineffective for actuating the valve;

a pivotal lever having a cylindrical surface portion radially spaced from and substantially concentric to the pivotal axis when said latch means is in said first position, said pivotal axis lying substantially in said cylindrical surface when said latch means is in said second position; and actuation means adapted to be mounted on the movable portion of the lash adjuster and including a plunger having an end for contacting and moving said cylindrical surface from said radially spaced position to said position wherein the axis lies substantially in said cylindrical surface.

* * * * *